US008646467B2

(12) United States Patent
Lelieveld et al.

(10) Patent No.: US 8,646,467 B2
(45) Date of Patent: Feb. 11, 2014

(54) SHAVING KIT WITH REPLACEMENT INDICATOR

(75) Inventors: Mark Johannes Lelieveld, Drachten (NL); Gerben Raap, Drachten (NL); Jasper Zuidervaart, Drachten (NL); Jan Bennik, Drachten (NL); Sint Baron, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/508,427

(22) PCT Filed: Dec. 2, 2010

(86) PCT No.: PCT/IB2010/055545

§ 371 (c)(1), (2), (4) Date: May 7, 2012

(87) PCT Pub. No.: WO2011/070486

PCT Pub. Date: Jun. 16, 2011

(65) Prior Publication Data

US 2012/0234345 A1 Sep. 20, 2012

(30) Foreign Application Priority Data

Dec. 8, 2009 (EP) ..... 09178279

(51) Int. Cl.
*A45D 27/22* (2006.01)

(52) U.S. Cl.
USPC ..... 132/289

(58) Field of Classification Search
USPC ..... 132/289, 282; 30/41, 41.7, 538, 541, 30/537; 222/67, 23, 51, 157–159, 192
See application file for complete search history.

(56) References Cited

U.S. PATENT DOCUMENTS

| | | | | |
|---|---|---|---|---|
| 5,240,107 | A | 8/1993 | Casale | |
| 7,234,239 | B2 * | 6/2007 | Saito et al. | 30/41 |
| 7,553,218 | B2 | 6/2009 | Morita | |
| 2002/0157683 | A1 * | 10/2002 | Gibbs | 132/289 |
| 2008/0052912 | A1 * | 3/2008 | Barry et al. | 30/41.7 |
| 2008/0172879 | A1 | 7/2008 | Salvatore | |
| 2009/0183379 | A1 | 7/2009 | Johnson | |

FOREIGN PATENT DOCUMENTS

| | | | |
|---|---|---|---|
| EP | 055835 | A1 | 7/1993 |
| GB | 2432807 | A | 6/2007 |
| GB | 2434982 | A | 8/2007 |
| WO | 2008088739 | A1 | 7/2008 |

* cited by examiner

*Primary Examiner* — Robyn Doan
*Assistant Examiner* — Brianne Kalach

(57) ABSTRACT

A shaving kit includes cartridge store for storing at least one spare blade cartridge and a container for storing a shaving fluid like a refreshing or cleaning lotion or a shaving foam. The container includes a volume of the shaving fluid which is sufficient for several series of shaving actions. After at least one shaving action, a blade razor may be coupled to the container to transfer shaving fluid to the blade razor. By transferring shaving fluid to the blade razor, the volume of shaving fluid in the container decreases. The container includes a replacement indicator for indicating a desired replacement of the blade cartridge. The replacement indicator operates in dependence on a volume of shaving fluid transferred from the container.

18 Claims, 2 Drawing Sheets

SHAVING KIT WITH REPLACEMENT INDICATOR

FIELD OF THE INVENTION

The invention relates to a shaving kit for a wet shaving system, wherein the wet shaving system includes a blade razor having a replaceable blade cartridge, the shaving kit comprising a cartridge store including at least one spare blade cartridge, and further comprising a container for storing a shaving fluid and for transferring the shaving fluid from the container to the blade razor.

The invention further relates to a shaving system comprising a shaving kit as described hereinabove and further comprising a blade razor having a replaceable blade cartridge.

BACKGROUND OF THE INVENTION

A shaving kit is known which has a blade razor, a container for a shaving fluid and a cartridge store. The blade razor has a handle including a grip and a head portion to fit a blade cartridge on the handle. The blade cartridge has a blade housing comprising a plurality of blades and a lubrication strip. The handle of the blade razor comprises a storage volume for an amount of shaving fluid. After the blade cartridge has been fitted, the storage volume is in fluid communication with the lubrication strip, such that the shaving fluid can flow from the storage volume to the lubrication strip. Consequently, during use, the lubrication strip is wetted by the shaving fluid, which is e.g. a shaving additive like a refreshing or cleaning lotion.

The blade cartridge is vulnerable to wear and contamination and has to be replaced after several shaving actions. The blades may become blunt or the lubrication strip may harden. The quality of the shaving process deteriorates when the blade cartridge is not replaced in due time. To warrant a timely replacement of the blade cartridge, the shaving kit has a discoloring lubrication strip. The color of the lubrication strip changes after several shaving actions, which triggers a user to replace the blade cartridge.

A disadvantage of this way of triggering a user for a replacement is that it is often inaccurate. The lubrication strip may for example simply discolor with the lapse of time, which may not be representative of wear of the blades or hardening of the lubrication strip. Consequently, the triggering for a replacement does not make any difference for a frequently or less frequently used shaving kit. In particular, when the shaving kit is used as a travel kit, the discoloring lubrication strip may not be satisfying. The shaving kit as a travel kit may be used on a daily basis during travel, but once back home the shaving kit remains unused. After a while back home, the discolored lubrication strip acting as a time-dependent replacement trigger may wrongly trigger for a replacement. The blade cartridge has been used only a few times during travel, but has no longer been used at home. The condition of the blades and lubrication strip may still be technically good enough for a satisfactory shaving result. Thus, time-dependent triggering might result in premature replacement, which will bring unnecessary costs to a consumer for new blade cartridges. Additionally, premature replacement of a blade cartridge is environmentally unfriendly.

SUMMARY OF THE INVENTION

It would be desirable to provide a shaving kit to at least partially eliminate the above drawbacks and/or provide a useable alternative. In particular, it is desired to provide a shaving kit having a more accurate indicator to trigger for a replacement of a used blade cartridge.

According to the invention, this object is achieved by means of a shaving kit for a wet shaving system. The shaving kit may e.g. be a refreshment kit including a container with a refreshing shaving fluid. The shaving kit is suitable for a shaving system which includes a blade razor and a replaceable blade cartridge.

The shaving kit according to the invention comprises a cartridge store for storing at least one spare blade cartridge and a container for storing shaving fluid like a refreshing or cleaning lotion or a shaving foam. The blade cartridge has a blade housing including at least one blade. During a shaving operation, the blade cartridge is manually replaceable by a user. The blade cartridge may be disposable.

The cartridge store comprises at least one blade cartridge as a spare blade cartridge. The spare blade cartridge may be fitted on a blade razor when the used blade cartridge has deteriorated. For example, the blades may have become blunt or the blade cartridge is contaminated with hardened shaving fluid.

Further, the shaving kit comprises a container for storing the shaving fluid. In particular, the container is a refill container. The container may comprise a volume of shaving fluid which is sufficient for several series of shaving actions. After at least one shaving action, the blade razor may be coupled to the container to transfer shaving liquid to the blade razor. A plurality of refill operations may be possible. The blade razor may e.g. be refilled as a result of capillary action, whereby shaving fluid is sucked from the container to the blade razor by a capillary channel of the blade razor. The blade razor may e.g. be refilled by sucking with a sponge. Alternatively, the container may have an operable fluid coupling to transfer shaving fluid to the blade razor. The blade razor may be connected in fluid communication to the container by the fluid coupling. By depressing a side wall of the container or by activating a pump, shaving fluid may be transferred to the blade razor. By transferring shaving fluid to the blade razor, the volume of shaving fluid in the container decreases.

Further, the shaving kit comprises a replacement indicator for indicating a desired replacement of the replaceable blade cartridge. The replacement indicator operates in dependence on a volume of shaving fluid transferred from the container. The replacement indicator may comprise a measuring member for measuring a remaining volume of shaving fluid in the container and a trigger member cooperating with the measuring member for triggering a desired replacement of the replaceable blade cartridge. The measuring member may be a measuring member which directly measures a remaining volume of shaving fluid in the container, e.g. by measuring the fluid level. The measuring member may e.g. be a float or an electronic sensor for measuring a fluid level, e.g. a capacitive sensor. Alternatively, the measuring member may indirectly measure the remaining volume by measuring the volume of transferred shaving fluid during refill operations.

Advantageously, the volume of shaving fluid transferred from the container may provide an accurate indication of the wear or contamination of the blades. In general, the lifetime of a blade cartridge strongly relates to the amount of shaving actions. The blades may for example become blunt after a series of shaving actions. The volume of transferred shaving fluid may accurately represent the amount of shaving actions. Thus, the replacement indicator based on the volume of transferred shaving fluid may provide an accurate trigger for a replacement of the used blade cartridge. By replacing the used blade cartridge in time, a user may enjoy a good shave. Additionally, the replacement indicator according to the invention may prevent premature replacement of the blade cartridge. By virtue thereof, the shaving process continues to be performed under optimum conditions, without blade cartridges being wasted.

In an embodiment of the shaving kit according to the invention, the replacement indicator comprises a LED (light emitting diode) or an array of LEDs as a trigger member. The number of LEDs may correspond with the available amount of spare blade cartridges in the cartridge store. The at least one LED may be positioned at a sidewall of the container. The array of LEDs may extend in a vertical direction which may correspond with vertically arranged spare blade cartridges. In a luxury version of the container, the container may comprise an electronic display, e.g. a LCD display, as a trigger member. The LED or display may be actuated by the measuring member to indicate whether a blade cartridge needs to be replaced.

In an embodiment of the shaving kit according to the invention, the replacement indicator comprises a fluid level window as a measuring member for visually indicating the remaining volume of shaving fluid in the container. The replacement indicator further comprises a trigger mark as a trigger member, which corresponds with a predefined volume of transferred shaving fluid, for triggering a desired replacement of the blade cartridge. The trigger mark may e.g. be a numbered scale which is positioned beside the fluid level window. Thus, advantageously, the replacement indicator has a simple and expedient configuration. A user may quickly recognize the need for a replacement. In a particular embodiment, the replacement indicator may further comprise a label having text to explain a user the meaning of the trigger marks in relation to the fluid level window.

In an embodiment of the shaving kit according to the invention, the cartridge store is positioned at a side wall of the container. The cartridge store may be selectively connected to the container. Instead of being releasable, the cartridge store may be fixed to the container. The cartridge store may be integral with the container. The cartridge store may e.g. be integrated in the container by blow moulding.

In an embodiment of the shaving kit according to the invention, the container has a bottom part and a sidewall, wherein the cartridge store is positioned at the side wall of the container. The trigger mark may be positioned at the side wall of the container at a level with respect to the bottom part that corresponds with a spare blade cartridge at said level. In a further embodiment, a plurality of trigger marks may be positioned at a corresponding level with regard to a plurality of spare blade cartridges. In use, the shaving fluid level decreases after each refill operation. The trigger marks may advantageously give a user a clear indication of the desirability of replacement of a spare blade cartridge when the trigger marks are positioned at the same level as, and preferably close to, the spare blade cartridges. Preferably, the trigger marks are positioned in between the measuring member, e.g. the fluid level window, and the cartridge store. By virtue thereof, a user can see at a single glance, and directly understand, that replacement of a blade cartridge is desired and additionally which spare blade cartridge has to be taken.

In an embodiment of the shaving kit according to the invention, the cartridge store is connected to the container and the replacement indicator comprises a release mechanism for releasing at least one blade cartridge from the cartridge store. The release mechanism may improve the triggering for a user. The release mechanism may prevent premature replacement of the blade cartridge by keeping the razor cartridge locked in the cartridge store. Unlocking the blade cartridge may induce the user to replace the blade cartridge. The release mechanism may be used in combination with the above mentioned fluid level window, but may also function by itself as a replacement indicator. A user may e.g. be triggered by a clicking sound at the moment of release or a user may be triggered to replace a blade cartridge when a spare blade cartridge is presented in an easy-to-grab position. In the easy-to-grab position, the blade cartridge may e.g. be tilted away from the cartridge store.

In an embodiment of the shaving kit according to the invention, the replacement indicator may comprise a float inside the container. The release mechanism may be actuated by the float. The float is positioned at the free surface of the shaving fluid. The float will drop inside the container when shaving fluid is transferred from the container, which causes the level of shaving fluid to fall. The float may be visible through a fluid level window and give a clear indication of the remaining volume of shaving fluid inside the container. In a particular embodiment, the float may have an eye-catching color, which will attract the attention of a user. When the level of shaving fluid corresponds with a predefined transferred volume, the level corresponds with one of the trigger marks, which give the user an unambiguous signal to replace the blade cartridge.

In an embodiment of the shaving kit according to the invention, the release mechanism may comprise a coupling member. The coupling member may connect the float to the cartridge store. The coupling member may extend along at least an inner wall portion of the container. The coupling member is coupled with the cartridge store at an outer wall portion of the container. The coupling member may e.g. be a flexible strip.

In an embodiment of the shaving kit according to the invention, the coupling member is magnetically coupled to the cartridge store. The coupling member may be a strip. The strip may have a flexible tip, which may deform when the flexible tip contacts a bottom surface of the container. The coupling member may be at least partly magnetic. As a result, the coupling member may hold blade cartridges to the container side wall by a magnetic force. When the level of the shaving fluid falls, the float with the coupling member fall also, which will move the magnetic holding force away from at least one blade cartridge. As a result, the blade cartridge is no longer held to the sidewall of the container and may be released to the easy-to-grab position. The spare blade cartridge may be taken out by the user to replace the used blade cartridge on the blade razor.

In an embodiment according to the invention, the coupling member may be mechanically coupled to the cartridge store. Some spare cartridges may be locked to the cartridge store by a snap-on mechanism. The coupling member may actuate the snap-on mechanism to release a blade cartridge from the cartridge store. The snap-on mechanism may be operated by the moving coupling member. When the coupling member moves downwards, the snap-on mechanism may become unlocked. The snap-on mechanism may be integrated in a flexible side wall portion of the container, wherein the coupling element provides a deformation of this flexible side wall portion to release a blade cartridge. Alternatively, the coupling member may extend through the side wall portion to release the snap-on mechanism from the cartridge store.

In an embodiment of the shaving kit according to the invention, the container comprises a fluid coupling for connecting a blade razor to the container and for transferring the shaving fluid from the container to the blade razor. Advantageously, the presence of the fluid coupling may provide an easy fluid connection of the blade razor to the container. The fluid coupling may advantageously prevent leakages.

In an embodiment of the shaving kit according to the invention, the fluid coupling of the container may comprise an electrical pump for transferring shaving fluid. The pump may be electrically connected in an electrical circuit which may further have a measuring member and a trigger member. The measuring member may measure a volume of transferred shaving fluid. If a predefined threshold value is achieved, a signal may be generated by the trigger member, which may be e.g. a LED. A user may be notified by the trigger member of a request to replace a used blade cartridge.

In an embodiment of the shaving kit according to the invention, the container comprises a clamp for selectively connecting the blade razor to the container. Advantageously, the container further serves as a holder for the blade razor. In a particular embodiment, the cartridge store may also be selectively connectable to the container. By virtue thereof, the shaving kit may be handsomely configured as a travel kit. The travel kit may be dimensioned in such a way that a compact travel kit results which advantageously does not take up much volume in a toilet bag.

The shaving system according to the invention comprises a shaving kit according to the invention having a container, a cartridge store and a replacement indicator together with a blade razor. The blade razor has a handle for gripping the blade razor and a head portion for selectively connecting a replaceable blade cartridge. Further, the shaving system includes a blade cartridge which is selectively connectable to the blade razor. As a result, a commercially interesting complete shaving kit may be provided. The all-inclusive shaving system advantageously may provide all necessities for a wet shaving process. Thus, the shaving system may be suitable as a travel shaving kit.

In an embodiment of the shaving kit according to the invention, the blade razor may have a compartment for storing shaving fluid, the shaving fluid being dischargeable during a shaving action. After at least one shaving action, the blade razor may be coupled to the container to refill the compartment of the blade razor with shaving fluid. Each refill action of a user leads to a further reduction of the amount of fluid in the container. After at least one refill action, the volume of transferred shaving fluid from the container may reach a predefined volume, which will trigger the user to replace the used blade cartridge.

Further preferred embodiments are defined in the sub claims.

BRIEF DESCRIPTION OF THE DRAWINGS

These and other aspects of the invention will be more readily appreciated as the same becomes better understood by reference to the following detailed description and considered in connection with the accompanying drawings in which like reference symbols designate like parts. The drawings show a practical embodiment according to the invention, in which.

DETAILED DESCRIPTION OF EMBODIMENTS

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

Specific features may also be considered apart from the shown embodiment and may be taken into account in a broader context as a delimiting feature, not only for the shown embodiment but as a common feature for all embodiments falling within the scope of the claims.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps).

Figure 1:
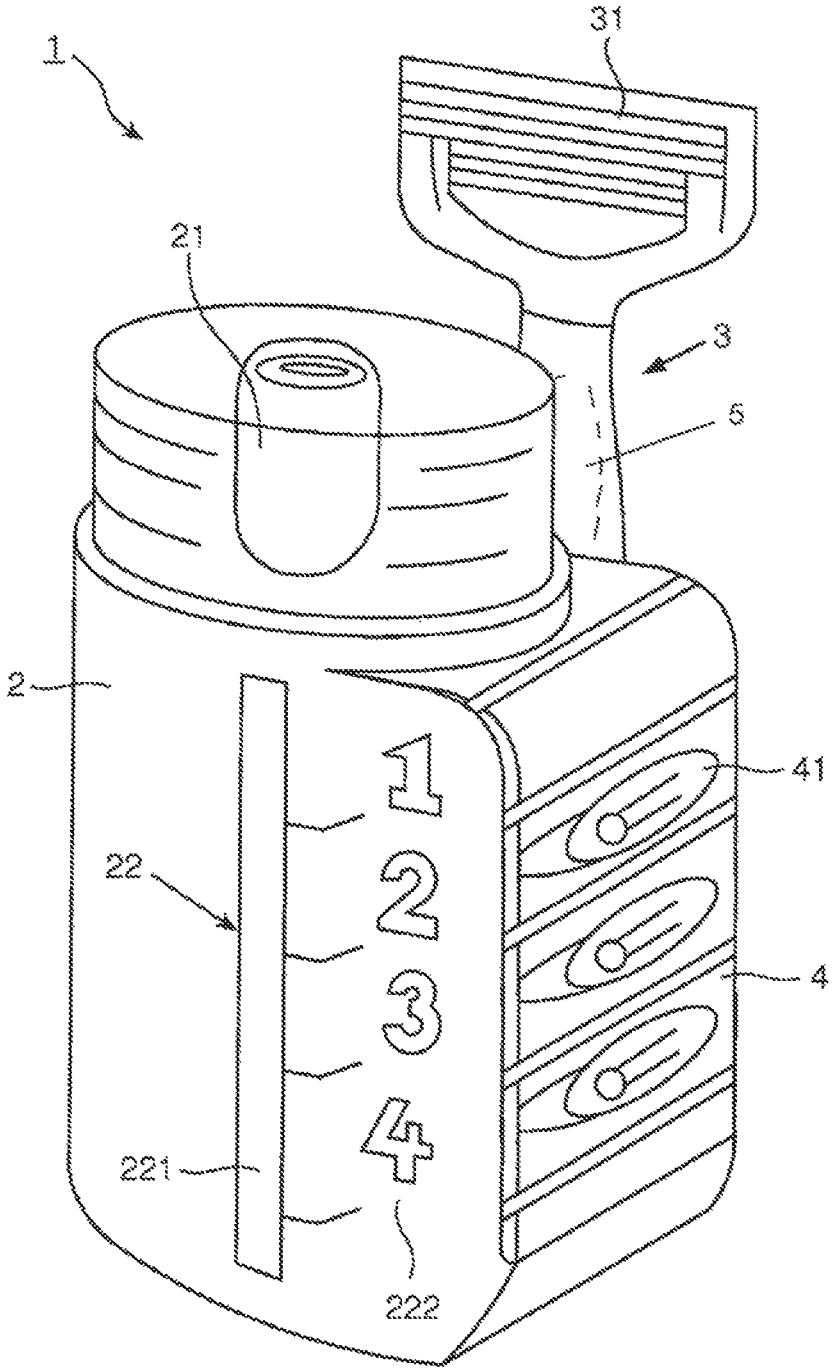
FIG. 1 shows in a perspective view an embodiment of a shaving system according to the invention.

FIG. 1 depicts a shaving system 1 according to the invention. The shaving system 1 comprises a blade razor 3, a container 2 and a cartridge store 4. The blade razor 3 and the cartridge store 4 are connected to a side wall of the container 2.

The blade razor 3 has a handle having a grip portion, a bottom portion and a head portion for selectively connecting a blade cartridge 31. The head portion is fork shaped. A replaceable blade cartridge 31 may be snapped to the head portion. Such a blade cartridge 31 is commonly known and has typically a blade housing comprising at least one blade. The blades are arranged side by side and have sharpened blade edges. The blade cartridge 31 may further have a lubrication strip which may be wetted by a shaving fluid.

The blade razor 3 has an inner space 5 which may be filled with the shaving fluid, e.g. a shaving additive such as a disinfecting agent or a shaving foam. The inner space 5 of the blade razor 3 may serve as a ready-to-use storage volume for the shaving fluid. The shaving fluid in the inner space may be in fluid communication with the lubrication strip of the blade cartridge 31 to transfer the shaving fluid finally to the lubrication strip or the blade edges. Subsequently, a skin may be wetted by the lubrication strip.

The container 2 of the shaving kit 1 is configured to store shaving fluid and to refill the inner space of the blade razor 3. The container 2 is closed by a lid which includes a fluid coupling 21. To fill the inner space, the blade razor 3 may be connected to the container by means of the fluid coupling 21. For example, the bottom portion of the handle may be connected to fluid coupling 21. The shown fluid coupling 21 comprises an electrical pump. The fluid coupling 21 has an inlet for sucking shaving fluid out of the container 2 and an outlet for discharging said shaving fluid from the container 2.

The blade razor 3 may be taken from the container 2 for a shaving action. After several shaving actions, the inner space for accommodating a shaving fluid may be empty. The user may couple the blade razor 3 to the container 2 to refill the inner space of the blade razor 3. The handle of the blade razor 3 may be coupled to the fluid coupling 21, wherein the engagement of the blade razor 3 to the container 2 activates a pump of the fluid coupling 21. The shaving fluid is subsequently pumped to the inner spare of the blade razor 3.

FIG. 1 further shows the container 2 having a bottom part and a circumferential side wall, wherein the container 2 comprises a replacement indicator 22 for indicating a desired replacement of a used blade cartridge 31. The container 2 is normally positioned at the flat bottom part which defines a horizontal reference. In the shown embodiment the replacement indicator 22 comprises a fluid level window 221 for visually indicating the remaining volume of shaving fluid in the container. The fluid level window 221 is an elongated transparent portion of the sidewall which extends in an upward direction from the bottom part of the container 2. The fluid level window 221 extends in a vertical direction when the container is in its normal position, i.e. resting on its bottom part. Beside the fluid level window 221 four trigger marks 222 are provided. The trigger marks are given numbers 1, 2, 3 and 4. This number of trigger marks corresponds with the number of spare blade cartridges in the cartridge store 4. The trigger marks 222 are positioned at the sidewall of the container at the same level as the spare blade cartridges.

When the blade razor 3 is refilled, the volume of remaining shaving fluid inside the container 2 decreases. The volume of remaining shaving fluid may be noticed by the user by looking at the fluid level window 221. The trigger marks 222 beside the fluid level window 221 will draw the user's attention to the fact that a replacement of the used blade cartridge 31 fitted on the blade razor 3 is desired. Thus, the reduced amount of shaving liquid in the container 2 may be indicative of the amount of wear of the blade edges or contamination of the lubrication strip. Being triggered by the trigger marks, the user will replace the blade cartridge 31, which will prevent the user from shaving with an inferior, deteriorated blade cartridge. A user may be prevented from shaving with blunt blade edges or with a lubrication strip which is worn out or too much contaminated. A high-quality shaving process may be warranted when the blade cartridges are replaced in due time. Thus, according to the invention the shaving process is further optimized.

As shown in FIG. 1, the cartridge store 4 is integrated in the container 2. The cartridge store 4 is provided at a side portion of the container 2. The selectively connectable blade razor 3 and the integrated container 2 with cartridge store 4 together define a handsome shaving kit 1 which is ideally usable as a travel kit.

Figure 2:
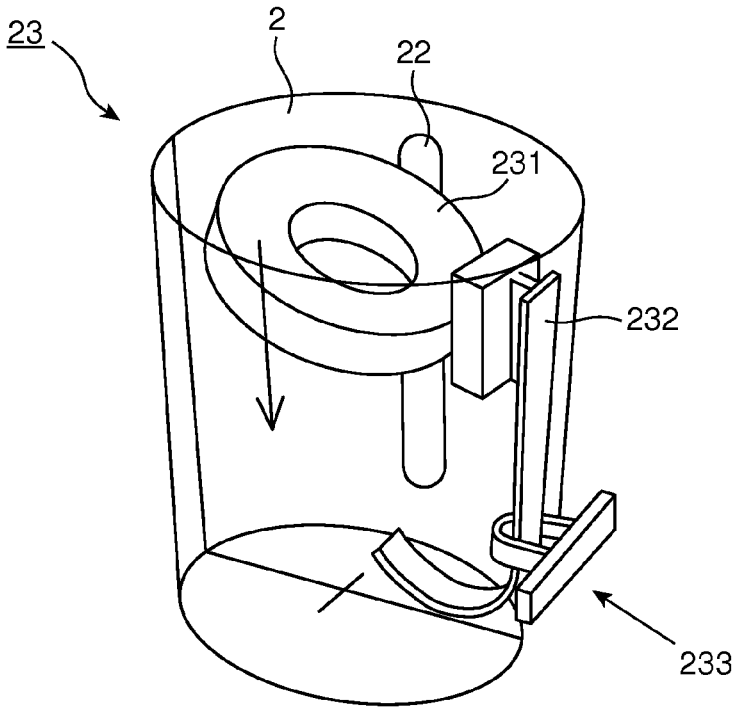
FIG. 2 shows in a cross sectional view a release mechanism of the shaving kit according to the invention.
Figure 3:
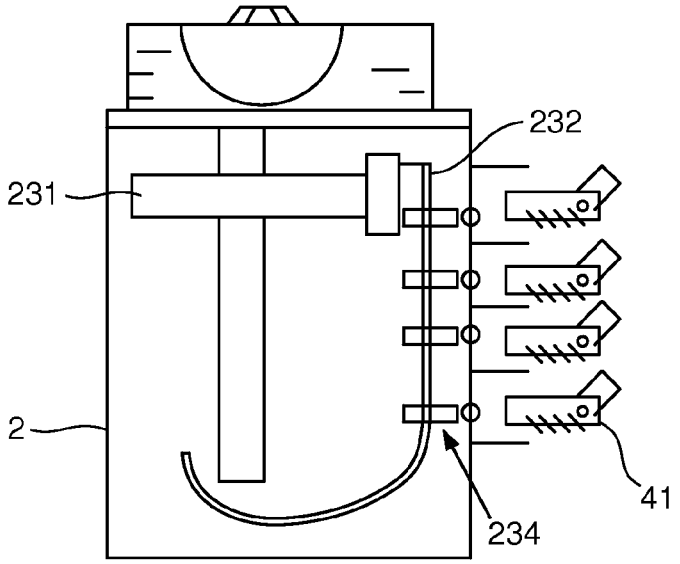
FIG. 3 shows in a cross sectional view an alternative embodiment of the release mechanism.

FIGS. 2 and 3 show different embodiments of a release mechanism 23. In both configurations the release mechanism 23 is arranged inside the container 2. The container 2 has a replacement indicator 22 including a fluid level window 221. The fluid level is indicated by a float 231. The float floats at the free surface of the volume of shaving fluid inside the container 2. As the container 2 becomes emptier, the float 231 drops inside the container 2. Besides the float 231, the release mechanism 23 further comprises a strip 232. The strip 232 is a coupling member which extends along an inner wall portion of the container 2. The strip 232 is connected to the float 231 and passes through a holding loop 233. If the float moves down, the strip moves together with the float. The coupling member 232 is coupled to at least one blade cartridge 41 at the outside of the container 2. In FIG. 2, the coupling member 232 is mechanically coupled to at least one outer blade cartridge 41 (not shown). A snap-on mechanism may be provided to release a blade cartridge when the float drops inside the container 2.

In FIG. 3, the coupling member 232 is magnetically coupled to at least one external blade cartridge 41. The coupling member 232 may comprise a magnetic strip which provides a holding force to adjacent blade cartridges at the outside of the container 2. When the magnetic strip moves downwards together with the float 231, the externally positioned blade cartridges are subsequently released from the container 2. Thus, the user has a clear trigger notifying him that the blade cartridge on the blade razor 3 needs to be replaced.

Although the invention has been disclosed with reference to particular embodiments, from reading this description those of ordinary skill in the art may appreciate changes and modification that may be possible from a technical point of view but which do not depart from the scope of the invention as described above and claimed hereafter.

Numerous variants are possible in addition to the embodiment shown. For example, in an alternative embodiment of the container, a fluid coupling may be provided which does not comprise an electrical pump, but a manually operated pump instead, wherein a user may manually pressurize the container by depressing a flexible side wall of the container, such that the shaving fluid flows from the container to the inner space of the blade razor. In an alternative embodiment, the blade razor may have an outer external space instead of an inner space or compartment for temporarily storing a dischargeable shaving fluid. Alternatively, the razor blade may be dipped into a pad of the container to transfer the shaving fluid to the blade cartridge of the blade razor.

Therefore, it is intended that the invention is not to be limited to the particular embodiments disclosed in the above detailed description, but that the invention will include all embodiments falling within the scope of the appended claims. Any reference signs in the claims should not be construed as limiting the scope of the claims or the invention. The mere fact that certain measures are recited in mutually different dependent claims does not indicate that a combination of these measures cannot be used to advantage.

Thus, the invention provides a shaving kit including a container with a replacement indicator. Advantageously, the shaving process may be optimized by using this shaving kit. The replacement indicator of the shaving kit may trigger a user to replace a blade cartridge in time. By virtue thereof, the user may be prevented from shaving with a worn blade cartridge.

The invention claimed is:

1. A shaving kit for a wet shaving system, wherein the wet shaving system includes a blade razor having a replaceable blade cartridge and an inner space, the shaving kit comprising:

a container storing a shaving fluid; a cartridge store including at least one spare blade cartridge, the cartridge store being connecting to a sidewall of the container; and a replacement indicator located within the container and configured to indicate replacement of the replaceable blade cartridge, wherein the replacement indicator operates in dependence on a volume of the shaving fluid within the container, and wherein the replacement indicator comprises a release mechanism for releasing the at last one spare blade cartridge from the cartridge store.

2. The shaving kit according to claim 1, wherein the replacement indicator further comprises a measuring member for measuring a remaining volume of the shaving fluid in the container and a trigger member cooperating with the measuring member for triggering the replacement indicator to indicate replacement of the replaceable blade cartridge.

3. The shaving kit according to claim 2, wherein the trigger member of the replacement indicator comprises at least one light emitting diode (LED).

4. The shaving kit according to claim 2, wherein the measuring member comprises a fluid level window for visually indicating the remaining volume of the shaving fluid in the container, and wherein the trigger member includes at least one trigger mark corresponding with a predefined volume of transferred shaving fluid for triggering the replacement indicator to indicate the replacement of the replaceable blade cartridge.

5. The shaving kit according to claim 4, wherein the container further has a bottom part, wherein the cartridge store is positioned adjacent to the sidewall of the container, wherein the trigger mark is positioned on the sidewall of the container at a level with respect to the bottom part that corresponds with the level of the at least one spare blade cartridge in the cartridge store.

6. The shaving kit according to claim 1, wherein the release mechanism is actuated by a float inside the container.

7. The shaving kit according to claim 6, wherein the float is connected to a coupling member which extends along at least an inner well portion of the container and which is coupled with the cartridge store at an outer wall portion of the container.

8. The shaving kit according to claim 7, wherein the coupling member is magnetically coupled to the cartridge store.

9. The shaving kit according to claim 7, wherein the coupling member is mechanically coupled to the cartridge store.

10. The shaving kit according to claim 7, wherein the coupling member actuates a snap-on mechanism to release at least one spare blade cartridge from the cartridge store.

11. The shaving kit according to claim 1, wherein the container comprises a fluid coupling for connecting the blade razor in fluid communication to the container.

12. The shaving kit according to claim 11, wherein the container comprises an electrical pump for transferring the shaving fluid from the container to the fluid coupling.

13. The shaving kit according to claim 12, wherein the container comprises a measuring member for measuring a volume of the shaving fluid transferred from the container, and wherein said measuring member cooperates with the replacement indicator.

14. A shaving system comprising a shaving kit and a blade razor having a replaceable blade cartridge, the shaving kit comprising:

a container storing a shaving fluid;

a cartridge store including at least one spare blade cartridge, the cartridge store being connecting to a sidewall of the container; and a replacement indicator located within the container and configured to indicate replacement of the replaceable blade cartridge, wherein the replacement indicator operates in dependence on a volume of the shaving fluid within the container, wherein the replacement indicator comprises a release mechanism for releasing the at last one spare blade cartridge from the cartridge store, and wherein the blade razor has a handle and a head portion for selectively connecting the replaceable blade cartridge, said replaceable blade cartridge having a blade housing including at least one hair-cutting blade.

15. The shaving kit of claim 1, further comprising a sensor configured to measure the volume of the shaving fluid that is transferred from the container, wherein the replacement indicator operates in dependence on the volume of the shaving fluid that is transferred from the container as measured by the sensor.

16. The shaving system of claim 14, further comprising a sensor configured to measure the volume of the shaving fluid that is transferred from the container, wherein the replacement indicator operates in dependence on the volume of the shaving fluid that is transferred from the container as measured by the sensor.

17. The shaving kit according to claim 1, wherein the container comprises a fluid coupling for transferring the shaving fluid from the container to the inner space of the blade razor.

18. The shaving kit according to claim 1, wherein the blade razor comprises a capillary channel for transferring the shaving fluid from the container to the blade razor by capillary action.

* * * * *